US005351739A

United States Patent [19]

Levy

[11] Patent Number: 5,351,739

[45] Date of Patent: Oct. 4, 1994

[54] SHOWER ROD AND SAFETY NET

[76] Inventor: James F. Levy, 434 Barnwell St., Columbia, S.C. 29202

[21] Appl. No.: 50,710

[22] Filed: Apr. 21, 1993

[51] Int. Cl.[5] ..... A47H 1/00

[52] U.S. Cl. ..... 160/124; 160/330; 160/DIG. 6; 4/558; 4/608

[58] Field of Search ..... 160/330, 345, DIG. 6; 4/558, 608; 16/87.2; 410/97, 118

[56] References Cited

U.S. PATENT DOCUMENTS

| | | | |
|---|---|---|---|
| 2,136,042 | 11/1938 | Cornell et al. | 160/345 X |
| 3,099,313 | 7/1963 | Peck et al. | 410/118 X |
| 3,231,007 | 1/1966 | Kerr | 160/345 X |
| 3,321,003 | 5/1967 | Boerner | 160/330 X |
| 4,377,195 | 3/1983 | Weil | 160/330 X |
| 5,189,758 | 3/1993 | Levy | 248/264 X |

*Primary Examiner*—Blair M. Johnson
*Attorney, Agent, or Firm*—Michael A. Mann

[57] ABSTRACT

A safety net suspended from a shower curtain rod in addition to the shower curtain for safety in the event of a fall. The safety net provides a structure for someone to grasp during the fall to either slow the fall or stop it before injuries occur. The netting is preferably made of NYLON in a strength sufficient to support the weight of an adult, and has a band along one side with a series of grommets attached to it. The rod is made to be stronger than a typical shower rod, preferably of the type that has a channel running lengthwise in it for supporting of a series of carriers. The exposed end of each carrier has a button that will pass through one of the grommets so that the netting can be hung by the grommets from the carriers.

20 Claims, 1 Drawing Sheet

SHOWER ROD AND SAFETY NET

BACKGROUND OF THE INVENTION

1. Field of the Invention

The present invention relates generally to safety devices. In particular, the present invention is a device that can be used to stop or slow a fall of a person who loses his balance while taking a shower or to help a person get back up who has fallen.

2. Discussion of Background

Modem bathroom plumbing usually includes a shower bath comprising a bathtub for tub baths and a shower head for shower baths. In some cases, to save space, the bathtub is eliminated and replaced by a simple shower stall. For water control, a shower curtain is hung from a rod spanning the opening of the open side of a tub annex or the opening of the shower stall. The shower curtain prevents water from being sprayed or splattered outside the confines of the tub or stall.

Typically, the rod for the shower curtain is made of lightweight aluminum or chrome-plated steel tubing and the curtain is hung by loops or hooks from the rod. Because the shower curtain is typically made of lightweight plastic sheeting, the rod is not made to be very strong. Sometimes heavier rods or hooks are used when a decorative panel and the water control panel are both suspended from the same rod and their combined weight dictates a sturdier rod.

Because the standing surface of a shower stall and the bottom of a bath tubs are smooth and because water runs over them during the course of a shower, they are inherently slippery. Soap on the standing surface will make it even more slippery. Bath mats or textured appliques are sometimes applied to this surface to prevent slipping. However, both mats and textured appliques usually do not cover the entire standing surface.

Furthermore, the side of a bathtub presents a barrier to be surmounted by someone entering or leaving the shower bath and people are more vulnerable to falls stepping over the side of the tub. Travelers who are lodging in hotels may be especially susceptible to slipping and falling, from fatigue or jet lag for example. Finally, many people shower when they first get up in the morning or at night before going to bed; the water may be relaxing, even a little bit disorienting to some. All of these factors may contribute to a situation where the bather may lose balance and fall while showering or while entering or leaving the shower.

Upwards of 100,000 people fall in showers every year in the U.S. and have injuries serious enough to warrant doctor care. These injuries run from bruises, chipped teeth and bone fractures to death. In some cases, glass shower doors may provide more support to someone who might be about to fall; in other cases, glass doors may contribute to the injuries because they, too, are slippery and might break. In any case, when a person is falling, reaching out for something to grab onto for support is instinctive.

SUMMARY OF THE INVENTION

According to its major aspects and briefly stated, the present invention is a lattice, and in particular, a netting, that is hung from a sturdy shower rod. Although preferably in the form of a knotted, NYLON cord netting, the present invention includes semi-rigid but foldable lattice-work having holes large enough and close enough for someone to easily and quickly insert fingers through to prevent or slow a fall. The lattice is attached to the rod by hangers that run freely from one end of the rod to the other and hold the lattice to the rod securely.

The netting is an important feature of the present invention. Netting inherently allows one to grab onto it anywhere to find a handhold and can slow or prevent a fall if the one falling reaches out and grabs onto the netting with enough force. NYLON netting in particular is strong enough in small diameter cords so that it is light weight and not obtrusive and will resist rotting from bathroom moisture.

Another important feature of the invention is the rod. The rod must obviously be strong enough and secured to the walls firmly enough to withstand a substantial portion of the weight of an adult who has grabbed onto the lattice suspended from the rod. Fastening the rod is largely a matter of proper attachment to sturdy walls. However, the rod itself is made of a material and engineered to support adult weight without giving way.

Finally, the method of hanging the netting from the rod is as important a feature of the present invention as the netting and the rod. The hangers run freely from one end of the rod to the other so that the shower curtain and netting can be pushed to the side but the hangers will hold the netting securely to the rod. The same hangers for the shower curtain can also be used to hang the netting. In the present invention, the preferred embodiment of the hangers is a combination of a series of grommets fastened to the top side of the netting and a corresponding series of carriers rolling in a channel formed in the rail. Each carrier has a button that fits into a grommet.

Other features and advantages will be apparent to those skilled in the art of bathroom fixtures from a careful reading of the Detailed Description of Preferred Embodiments, accompanied by the drawings described in the following Brief Description of the Drawings.

DETAILED DESCRIPTION OF PREFERRED EMBODIMENTS

Figure 1:
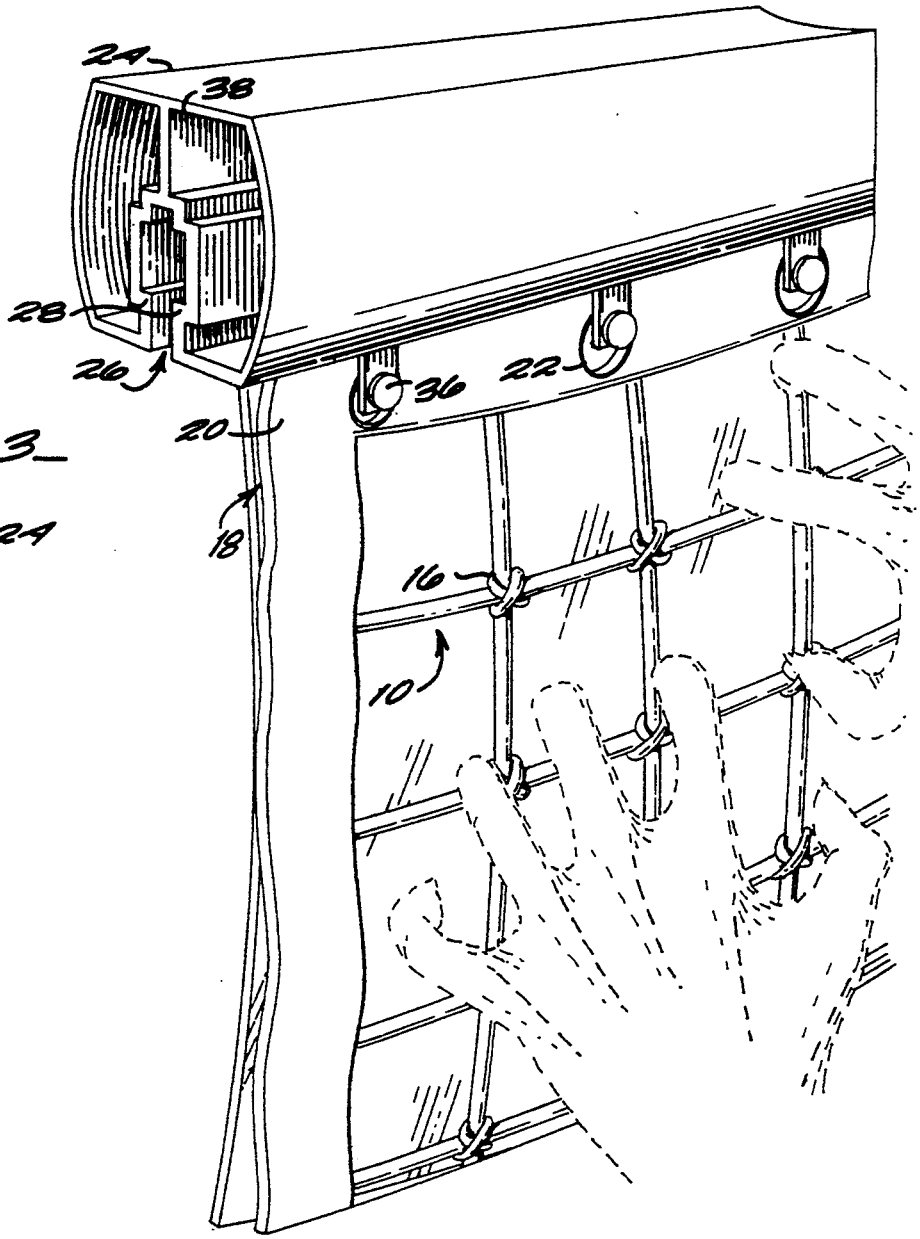
FIG. 1 is a perspective view of a device according to a preferred embodiment of the present invention.
Figure 3:
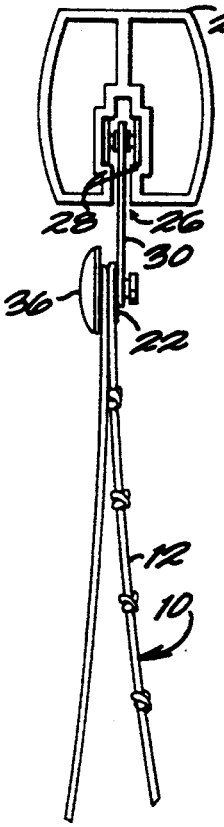
FIG. 3 is a portion of a side view of a device according to a preferred embodiment of the present invention.
Figure 2:
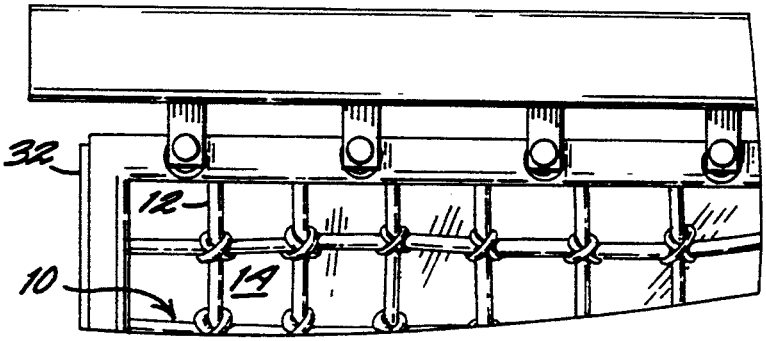
FIG. 2 is a detailed front view of a device according to a preferred embodiment of the present invention.

Referring now to the drawings, FIGS. 1, 2 and 3 illustrate an article made according to the present invention and shown in its environment of use. Simply stated, the preferred embodiment is a netting hung from a strong shower rod by strong carriers. The netting gives a person something to grasp in order to stop or at least slow a fall, to use to pull himself or herself back up following a fall or to simply steady himself or herself when entering or leaving a shower. The article is not a substitute for caution or care on the part of the individual using the shower and cannot always prevent injuries: the person falling must have the presence of mind to grab onto it and have the strength to hold on until balance is regained; and injuries may still result if the individual has only one hand on the netting and twists as a result of the one-hand hold. But having something to hold onto is usually better than nothing and having something that can be grasped anywhere is better than a handhold or bar that is fixed in a single location.

The article is a lattice or has a lattice-type structure By lattice, it is meant that the structure of the article includes a plurality of holes that are large enough and are close enough to enable the user to put at least one finger in each hole and fingers of the same hand in adjacent holes without undue strain. Moreover, the lattice need not be particularly flexible other than to be foldable. An "accordion-fold" material with a plurality of closely-spaced holes, in a regular array or randomly placed, such as a "pebble" pattern, would provide the necessary number and spacing of holes to be grippable quickly and easily in the event of a fall.

However, the simplest lattice-type structure is netting, as shown in the figures and generally indicated by the reference numeral 10, made of a material that is not likely to rot, such as NYLON, or other synthetic material, in the form of a system of cords 12. The cords of the system are arranged in two or more sets of parallel cords, spaced about one to two inches apart, each set comprising a number of cords running in parallel to each other and running at an angle with respect to other sets so that they intersect to define holes 14 through which at least two fingers can pass, and fastened together where they intersect. By "intersect" it is meant that a cord of one set will pass near the cord of another set but not in a parallel path. Rather, the paths of different sets are at an angle with respect to each other. If there are two sets, a 90° angle is preferred. Preferably, the cords are knotted in "fishnet" fashion where they intersect to connect them together, but, instead of knots 16 as shown, staples or plastic rings can be used in the alternative to connect or fasten intersecting cords together. The netting is preferably strong enough to support the weight of an adult but, as long as it is sufficiently strong so that it tears slowly enough to retard the fall, it will help to reduce the seriousness and number of injuries.

Along the edges of the netting is a seam 18 to maintain the structure and integrity of the netting. Along one edge, designated the top, the seam is preferably covered with a band 20 of NYLON or equivalent material. A series of grommets 22 are attached along this edge through the band, and preferably with at least one cord of the netting above the grommets so that, if band 20 fails, the one or two cords of the netting fall onto the axles of the buttons, as shown in FIG. 3. Grommets may be metal or hard plastic.

A shower rod 24 used to hand netting 10 is preferably a strong rod, either by virtue of design or material strength or both. Preferably, rod 24 is of the sort described in my U.S. Pat. No. 5,189,758 issued Mar. 2, 1993 for a Support System for a Flexible Closure, incorporated herein by reference. Rod 24 has a channel 26 formed in it and running lengthwise from one end to the other. Channel 26 includes a pair of ledges that serve as rails 28 for carriers 30 that hold a shower curtain 32, and in the present invention, netting 10 as well. Carriers 30 have rollers 34 on one end to roll on rails 28 of channel 26 and buttons 36 on the other end to which the shower curtain 32 and grommets 22 are attached. A decorative outer panel (not shown )can also be attached to buttons 36. Carriers 30 extend from the bottom of rod 24 and roll freely from one end to the other. Rod 24 is preferably made of extruded aluminum and has a vertical member 38 for internal support against bowing.

The word "carriers" is used herein to mean a series of connections between rod 24 and netting 10 that allow netting 10 to be pushed from one end of rod 24 to the other but suspend netting 10 from the rod 24 securely. Carriers 30 can be metal or plastic rings that encircle rod 24 and pass through grommets 22 or can be hooks if sturdy enough so that they do not open up to allow netting 10 to slide off. Preferably carriers 30 are made of sturdy plastic with rollers 34 on one end for rolling in channel 26 inside rod 24 and buttons 36 on the other end to pass through grommets 22 for attachment of netting 10. Preferably one or two cords along the top edge of seam 20 will be above grommets 22 so that, if seam 20 tears, these cords will fall onto the axles of buttons 36. Alternatively, if the seam along the top edge of netting 10 is dimensioned so that rod 24 might be slid through it so that rod 24 is inside the seam.

Clearly, the method of installation must also be appropriate to the task. Furthermore, the method of installation will vary depending on the support structure available. However, installation techniques that will hold the present rod 24 with netting 10 to a wall are well known in the art. For example, rod 24 can be fitted through a collar and the collar bolted or screwed into a stud in a wall. Expansion bolts in drywall may also be sufficient. Alternatively, but not necessarily preferably, the method of attachment of the rod can be the same as described in my copending U.S. Pat. application Ser. No. 07/909,696, filed Jul. 7, 1992, for a Flexible Closure Carrier, incorporated herein by reference. In this method, the rod rests on a pair of flanges, with an upstanding member being straddled by the rod so that it fits into the rods channel. A pendulum lock holds the rod down but can be rotated out of the way to allow the rod to be lifted off the wall mount for removal of the carriers. This method allows the rod to be removed easily but will still hold it securely.

Netting 10 should be as wide as the open side of a shower bath or shower stall. If the tub is free-standing and the shower curtain encircles it, the netting should also be wide enough to encircle the tub. Because the netting will be on the inside of the tube, with the shower curtain between it and the tub wall or the shower curtain wall, it is not necessary that the netting be more than a few feet in height, approximately four feet is usually sufficient or from the rod down to just inside the top of the tub.

It will be apparent from a careful reading of the Detailed Description of Preferred Embodiments that many changes and additions may be made to the preferred embodiments without departing from the spirit and scope of the invention, which is defined by the appended claims.

What is claimed is:

1. An article for use with a shower rod having a plurality of carriers for hanging a shower curtain across a shower stall having an open side, said article comprising a shower curtain;

a foldable lattice defining a plurality of closely spaced holes, said lattice and said showers curtain being dimensioned to each cover said open side of said shower stall; and means for handing said shower curtain and said foldable lattice from said shower rod so that said shower curtain and said lattice can each cover said open side of said shower stall.

2. The article as recited in claim 1, wherein said holes are dimensioned to receive at least one finger of a hand and spaced closely enough so that any two adjacent fingers of a hand can be received by any two adjacent holes.

3. The article as recited in claim 1, wherein said lattice is a netting made of an array of cords including at least two sets of cords, each set of cords running in a different direction with respect to the other set of cords, said cords of said at least two sets of cords being connected together where they intersect.

4. The article as recited in claim 1, wherein said lattice is a netting made of a first set of cords and a second set of cords, said first set running in a first direction and said second set running in a second direction, said first direction and said second direction being at an angle greater than zero with respect to each other so that cords of said first set intersect with cords of said second set, said cords of said first set of cords and said second set of cords being connected together where said cords of said first and said second sets intersect.

5. The article as recited in claim 1, wherein said lattice is a netting made of a first set of cords and a second set of cords, said first set and said second set running in directions approximately at right angles with respect to each other so that cords of said first set intersect at approximately right angles with cords of said second set, said cords of said first and second sets of cords being connected together where said cords of said first and said second sets intersect.

6. The article as recited in claim 1, wherein said lattice is a netting made of a first set of cords and a second set of cords, said first set and said second set running in directions approximately at right angles with respect to each other so that cords of said first set intersect at approximately right angles with cords of said second set, said cords of said first and second sets of cords being knotted together where said cords of said first and said second sets intersect.

7. The article as recited in claim 1, wherein said lattice has a side and wherein said hanging means further comprises a seam formed in said side, said seam dimensioned to receive said shower rod.

8. The article as recited in claim 1, wherein said lattice has a side and wherein said hanging means is attached to said side and is carried by said carriers when said article is hanging from said shower rod.

9. The article as recited in claim 1, wherein each of said carriers carry a button, and wherein said lattice has a side and said handing means further comprises a series of grommets attached to said side, said buttons adapted to fit into said grommets.

10. An article for use with a shower stall having an open side, said article comprising a shower curtain;

a rod attachable to said shower stall across said open side;

a lattice defining a plurality of closely spaced holes; and means for slidably hanging said lattice and said shower curtain from said rod so that said lattice and said shower curtain can each slide along said rod for covering said open side of said shower stall.

11. The article as recited in claim 10, wherein said lattice is a netting made of a first set of cords and a second set of cords, said first set running in a first direction and said second set running in a second direction, said first direction and said second direction being at an angle with respect to each other so that cords of said first set of cords intersect with cords of said second set of cords, said cords of said first set of cords and said second set of cords being connected together where said cords of said first and said second sets intersect.

12. The article as recited in claim 10, wherein said lattice is a netting made of a first set of cords and a second set of cords, said first set and said second set running in directions approximately at right angles with respect to each other so that cords of said first set of cords intersect at approximately right angles with cords of said second set of cords, said cords of said first and second sets of cords being connected together where said cords of said first and said second sets intersect.

13. The article as recited in claim 10, wherein said lattice is a netting made of a first set of cords and a second set of cords, said first set and said second set running in directions approximately at right angles with respect to each other so that cords of said first set of cords intersect at approximately right angles with cords of said second set of cords, said cords of said first and second sets of cords being knotted together where said cords of said first and said second sets intersect.

14. The article as recited in claim 10, wherein said lattice has a side and wherein said hanging means further comprises a series of carriers carried by said rod so as to slide freely, said carriers being attached to said side of said lattice.

15. The article as recited in claim 10, wherein said lattice has a side and wherein said hanging means further comprises a band attached along said side and a series of grommets attached to said band, said lattice being hung by said grommets.

16. The article as recited in claim 10, wherein said lattice has a side and said rod has a first end and an opposing second end, and wherein said hanging means further comprises:

a series of grommets in said side; and a series of carriers carried by said rod and able to travel along said rod freely from said first end to said second end, each carrier of said series of carriers having a button, said button fitting into a grommet of said series of grommets.

17. The article as recited in claim 10, wherein said rod has a channel formed therein and said hanging means further comprises a series of carriers riding in said channel and supported therefrom, each carrier of said series of carriers having a button, and said lattice has a side having a series of grommets attached thereto, said button being fasted to each grommet of said series of grommets so that said lattice hangs by said grommets from said buttons of said carriers.

18. An article, comprising:

a shower rod having a first end a shower curtain having a folded position and an unfolded position; and an opposing second end;

a netting having a folded position and an unfolded position and substantially overlapping said shower curtain, said netting and said shower curtain each extending from said first end to said second end of said shower rod when in said unfolded position, said netting made of an array of cords and having a side; and means for slidably hanging said side of said netting and said shower curtain each from said shower rod, said hanging means allowing said netting and said shower curtain each to slide along said shower rod from said first end to said second end.

19. The article as recited in claim 18, wherein said hanging means is attached to said side and is carried by said shower rod, said hanging means running freely along said shower rod and carried by said shower rod.

20. The article as recited in claim 18, wherein said hanging means further comprises:

a series of grommets in said side; and a series of carriers carried by said shower rod and able to travel along said shower rod freely from said first end to said second end, each carrier of said series of carriers having a button, said button fitting into a grommet of said series of grommets.

* * * * *